US007559801B1

(12) United States Patent
Lin et al.

(10) Patent No.: US 7,559,801 B1
(45) Date of Patent: Jul. 14, 2009

(54) AUDIO JACK CONNECTOR

(75) Inventors: Kuo-Chin Lin, Tu-Cheng (TW); Feng Zhu, Tu-Cheng (TW); Xing-Yu Hu, Tu-Cheng (TW)

(73) Assignee: Cheng Uei Precision Industry Co., Ltd., Taipei Hsien (TW)

( * ) Notice: Subject to any disclaimer, the term of this patent is extended or adjusted under 35 U.S.C. 154(b) by 0 days.

(21) Appl. No.: 12/219,170

(22) Filed: Jul. 17, 2008

(51) Int. Cl.
*H01R 13/648* (2006.01)

(52) U.S. Cl. ..... 439/607

(58) Field of Classification Search ..... 439/74, 439/608, 63, 101, 607
See application file for complete search history.

(56) References Cited

U.S. PATENT DOCUMENTS 6,093,058 A * 7/2000 Wu ..... 439/607
6,210,226 B1 * 4/2001 Zhu et al. ..... 439/607
6,312,267 B1 * 11/2001 Wang ..... 439/92
6,604,964 B2 * 8/2003 Hoshino et al. ..... 439/607

* cited by examiner

*Primary Examiner*—Neil Abrams
*Assistant Examiner*—Phuong Nguyen
(74) *Attorney, Agent, or Firm*—Rosenberg, Klein & Lee

(57) ABSTRACT

An audio jack connector connected with a printed circuit board includes a dielectric housing, a connecting terminal, at least one grounding terminal and a shell. The dielectric housing defines a passageway therethrough. The connecting terminal is received in the passageway of the dielectric housing. The grounding terminal is fixed on the dielectric housing. The grounding terminal has a contact portion exposed outside the dielectric housing and a connecting portion for being connected with the printed circuit board. The shell encloses the dielectric housing and detachably contacts the contact portion of the grounding terminal. As the grounding terminal is separated with the shell, the grounding terminal and the shell can be made independently, which can not only save materials but also reduce the reject rate of the audio jack connector.

2 Claims, 3 Drawing Sheets

AUDIO JACK CONNECTOR

BACKGROUND OF THE INVENTION

1. Field of the Invention

The present invention generally relates to a connector, and more particularly to an audio jack connector with a grounding terminal.

2. The Related Art

A conventional audio jack connector includes a dielectric housing, a connecting terminal received in the dielectric housing, and a shell surrounding the dielectric housing. A long grounding terminal extending from the shell has an inserting portion at a free end thereof. The grounding terminal is preferably an integrally molded portion of the shell. When the audio jack connector is assembled, the shell encloses the dielectric housing while the grounding terminal is beyond the dielectric housing. The inserting portion of the grounding terminal is inserted into a printed circuit board connected with the audio jack connector. The interference of the signals is led to a grounding point of the printed circuit board via the grounding terminal.

However, the grounding terminal is much long and of an integrally molded portion of the shell. The manufacture of the shell integrated with the long grounding terminal wastes materials. Moreover, during the grinding process, the grounding terminal is easy to be destroyed due to the compression and impact of the grinding mold thereupon, which increases the reject rate.

SUMMARY OF THE INVENTION

An object of the present invention is to provide an audio jack connector which can save materials and reduce the reject rate. The audio jack connector connected with a printed circuit board includes a dielectric housing, a connecting terminal, at least one grounding terminal and a shell. The dielectric housing defines a passageway therethrough. The connecting terminal is received in the passageway of the dielectric housing. The grounding terminal is fixed on the dielectric housing. The grounding terminal has a contact portion exposed outside the dielectric housing, and a connecting portion is for being detachably connected with the printed circuit board. The shell encloses the dielectric housing and contacts the contact portion of the grounding terminal. As the grounding terminal is separated with the shell, the grounding terminal and the shell can be made independently, which can not only save materials but also reduce the reject rate of the audio jack connector.

BRIEF DESCRIPTION OF THE DRAWINGS

The present invention will be apparent to those skilled in the art by reading the following description of a preferred embodiment thereof, with reference to the attached drawings, in which.

DETAILED DESCRIPTION OF THE PREFERRED EMBODIMENT

Figure 1:
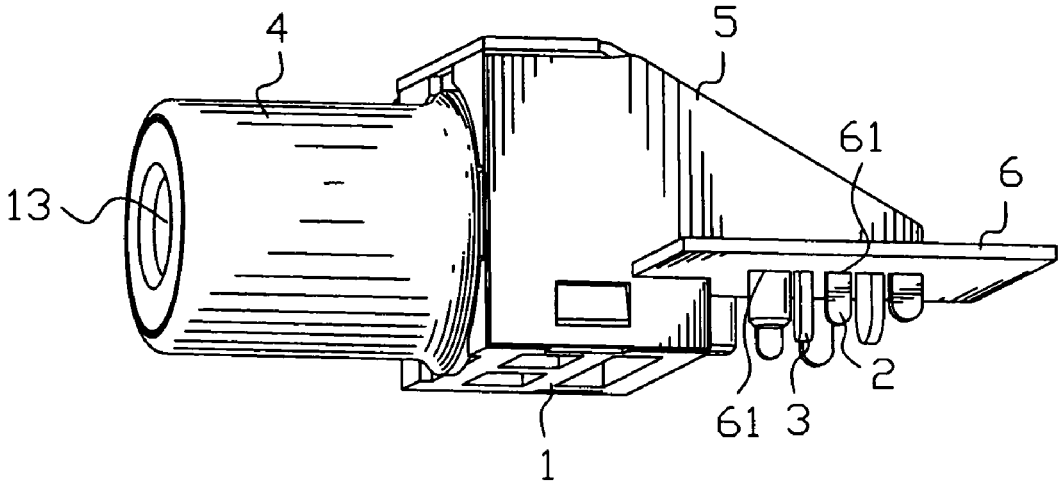
FIG. 1 is a perspective view of an audio jack connector in accordance with the present invention.
Figure 2:
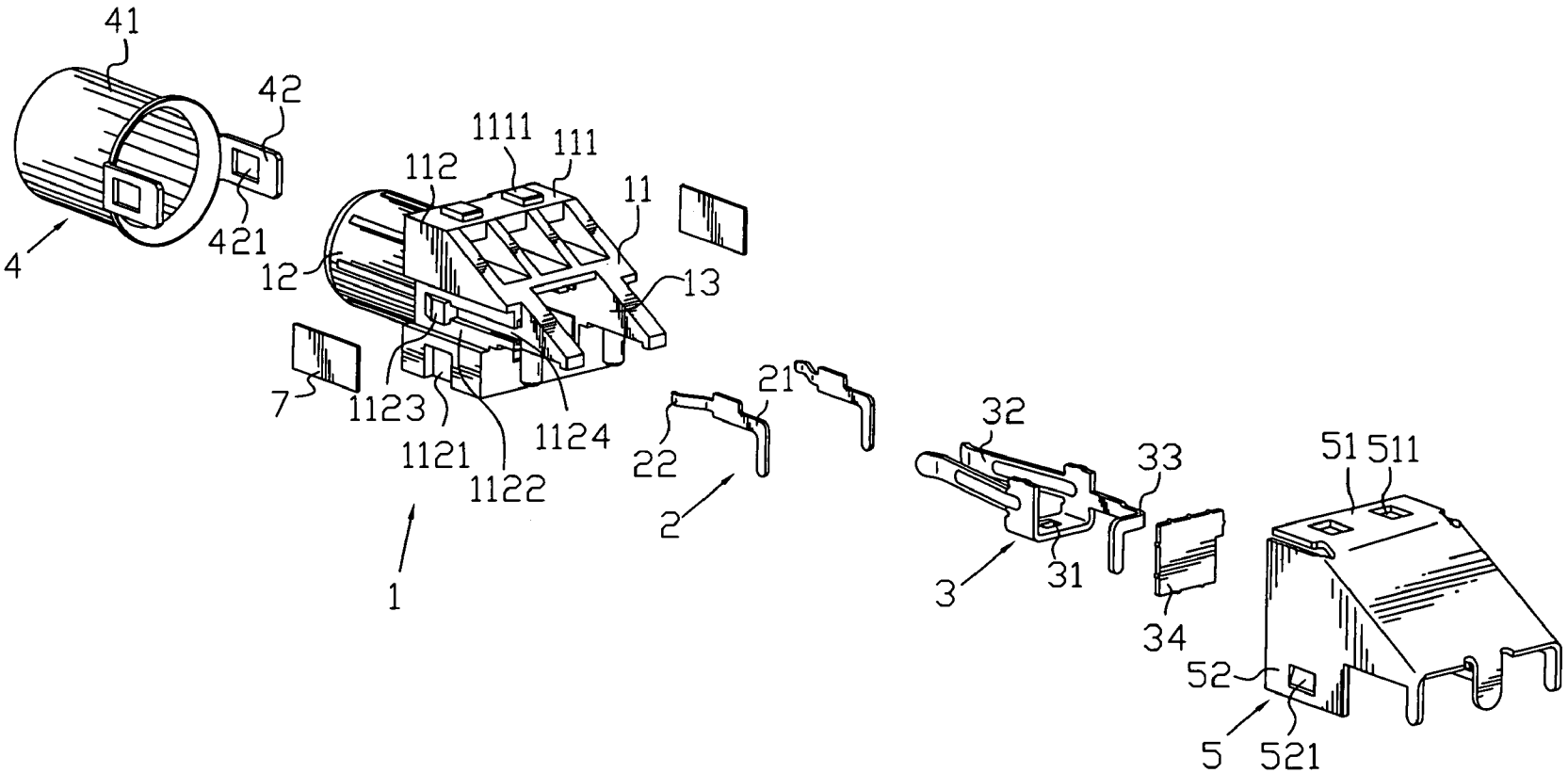
FIG. 2 is an exploded view of the audio jack connector of FIG. 1.

With reference to FIG. 1 and FIG. 2, an audio jack connector connected to a printed circuit board 6 which defines several grounding holes 61 therein includes a dielectric housing 1, a certain number of grounding terminals 2, a connecting terminal 3 received in the dielectric housing 1 and a shell for enclosing the dielectric housing 1.

Referring to FIG. 2, the dielectric housing 1 has a basic portion 11, a mating portion 12 which for example may be a cylindrical shape and may be extended from one end of the basic portion 11, and a passageway 13 which may be defined at the other end of the basic portion 11. The substantially cylindrical mating portion 12 is shown extended forward from a front end of the basic portion 11. The passageway 13 extends along the axis of the mating portion 12 and passes through both the basic portion 11 and the mating portion 12. The basic portion 11 defines a top wall 111 and two sidewalls 112 perpendicularly connected to the top wall 111. Two lumps 1111 protrude upwardly from the top wall 111 and are spaced away from each other. Two indentations 1121 are formed on the bottom of the two sidewalls 112 respectively. In addition, two receiving grooves 1122 are formed in the middle portion of the two sidewalls 112 respectively. A bump 1123 protrudes outwardly from a bottom surface of each receiving groove 1122. The bottom surface of each receiving groove 1122 defines a slot 1124. One end of the slot 1124 is adjacent to the bump 1123 and the other end thereof passes through a rear portion of the sidewall 112.

Each grounding terminal 2 has a substantial L-shaped connecting portion 21 and a contact portion 22 obliquely extended from one end of the connecting portion 21. The contact portion 22 is located outside of a plane which the connecting portion 21 lies in. A portion of the connecting portion 21 is received in the slot 1124 such that the contact portion 22 is exposed out of the slot 1124 and adjacent to the bump 1123 of the dielectric housing 1. The other portion of the connecting portion 21 is inserted into the grounding hole 61 of the printed circuit board 6 so as to be connected with the printed circuit board 6.

The connecting terminal 3 may be received in the passageway 13 and may have an U-shaped main body 31 and two arms 32. The two arms 32 extend forward from two lateral ends of the main body 31 and project toward each other. The two arms 32 are received in the passageway 13 and in the vicinity of in the mating portion 12. An inserting portion 33 extends rearwardly from one lateral end of the main body 31 a distance and then, extends toward the other lateral end of the main body 31 and finally extends downwardly. The inserting portion 33 is arranged outside the dielectric housing 1 and a free end of the inserting portion 33 is inserted into the printed circuit board 6. To prevent solder and dust from getting into the basic portion 11 of the dielectric housing 1, a cover 34 is provided to seal the rear of the passageway 13.

Figure 3:
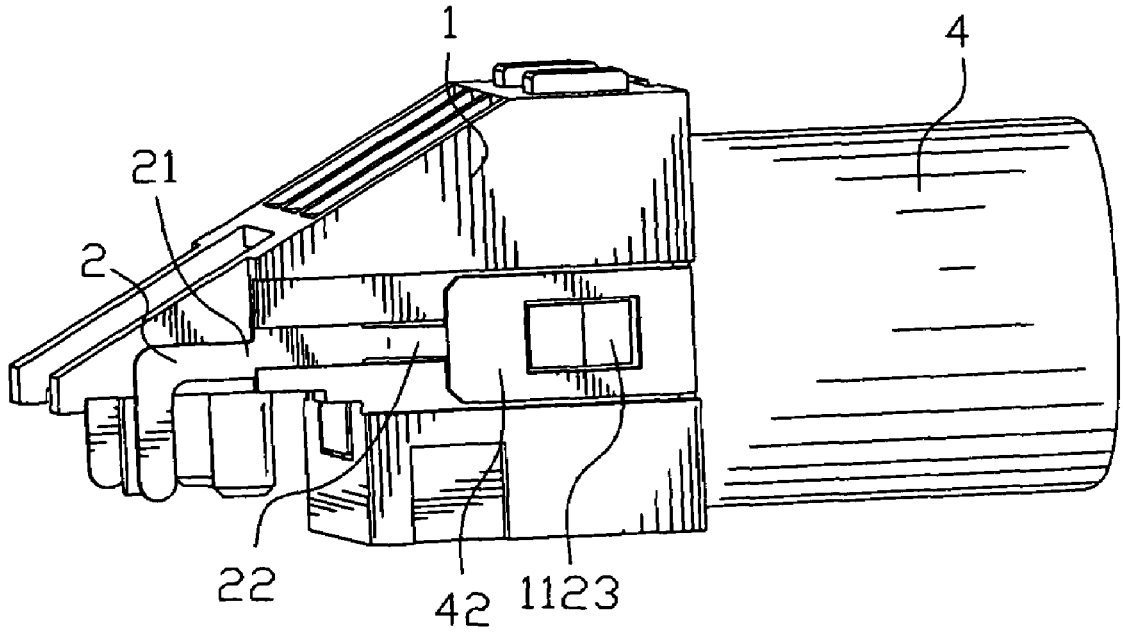
FIG. 3 is a perspective view of the audio jack connector shown in FIGS. 1-2 with a rear shell removed.

The shell includes a front shell 4 and a rear shell 5. The front shell 4 has a hollow cylindrical base 41 and two facing buckling flakes 42 symmetrically extending rearwardly from a rear end of the base 41. The base 41 encloses an outer surface of the mating portion 12 of the dielectric housing 1. An aperture 421 is formed in each buckling flake 42. The two apertures 421 of the buckling flakes 42 engage with the two bumps 1123 respectively and the buckling flakes 42 contact free ends of the contact portions 22 exposed out of the slots 1124 (shown in FIG. 3). The interference of the signals is fed to the grounding holes 61 of the printed circuit board 6 via the grounding terminal 2.

The rear shell 5 defines a top board 51 and two sideboards 52 interconnecting the top board 51. Two openings 511 are formed in the top board 51 and two projections 521 are formed in the two sideboards 52 respectively. The two openings 511 mate with the two lumps 1111 respectively and the two projections 521 are received in the two indentations 1121 respectively to make the rear shell 5 cover the dielectric housing 1 tightly. To insulate the rear shell 5 from the contact portions 22 of the grounding terminals 2, two insulation pieces 7 are provided to be disposed between the two sideboards 52 of the rear shell 5 and the contact portions 22 of the grounding terminals 2 respectively. The two insulation pieces 7 are also disposed between the two buckling flakes 42 of the front shell 4 and the two sideboards 52 of the rear shell 5.

The bumps 1123 of the dielectric housing 1 mate with the apertures 421 of the front shell 4, the lumps 1111 of the dielectric housing 1 mate with the openings 511 of the rear shell 5 and the indentations 1121 mate with the projects 521, so that the dielectric housing 1 is securely packaged by the front shell 4 and the rear shell 5.

As described above, the grounding terminals 2 are separated with the shell, therefore the grounding terminals 2 and the shell can be made independently of each other, which can not only save materials but also reduce the reject rate of the audio jack connector according to the present invention.

The foregoing description of the present invention has been presented for purposes of illustration and description. It is not intended to be exhaustive or to limit the invention to the precise form disclosed, and obviously many modifications and variations are possible in light of the above teaching. Such modifications and variations that may be apparent to those skilled in the art are intended to be included within the scope of this invention as defined by the accompanying claims.

What is claimed is:

1. An audio jack connector connected with a printed circuit board, comprising:

a dielectric housing defining a passageway therethrough;

a connecting terminal received in the passageway of the dielectric housing;

at least one grounding terminal fixed in the dielectric housing, the grounding terminal having a contact portion exposed outside the dielectric housing, and a connecting portion adapted for being connected with the printed circuit board; and a shell enclosing the dielectric housing and detachably contacting the contact portion of the grounding terminal;

wherein the dielectric housing has a basic portion defining two sidewalls and a mating portion extending forward from one end of the basic portion, the shell has a substantially cylindrical base enclosing the mating portion of the dielectric housing, and two facing buckling flakes extending from one end of the base and attached to the two sidewalls of the basic portion, and the buckling flakes contact the contact portions of the grounding terminals exposed from the sidewalls, the two sidewalls of the basic portion respectively protrude outwardly to form a bump, and an aperture is defined in each buckling flake of the shell for engaging with the corresponding bump of the dielectric housing.

2. The audio jack connector as claimed in claim 1, wherein each sidewall defines a slot with one end adjacent to the bump and the other end passing through a rear of the sidewall for fixing the grounding terminal therein, and the contact portion is exposed out of the slot and adjacent to the bump.

* * * * *